US009272534B2

(12) United States Patent
Domeier et al.

(10) Patent No.: US 9,272,534 B2
(45) Date of Patent: Mar. 1, 2016

(54) PRINTING DEVICE FOR PRINTING ON CONTAINERS

(71) Applicant: KRONES AG, Neutraubling (DE)

(72) Inventors: Bernhard Domeier, Hohengebraching (DE); Andreas Kraus, Lappersdorf (DE); Frank Winzinger, Regensburg (DE); Andreas Sonnauer, Wörth (DE); August Peutl, Wörth (DE); Bernd Schroll, Regensburg (DE)

(73) Assignee: KRONES AG, Neutraubling (DE)

( * ) Notice: Subject to any disclaimer, the term of this patent is extended or adjusted under 35 U.S.C. 154(b) by 0 days.

(21) Appl. No.: 14/184,850

(22) Filed: Feb. 20, 2014

(65) Prior Publication Data

US 2014/0285600 A1 Sep. 25, 2014

(30) Foreign Application Priority Data

Mar. 25, 2013 (DE) ..... 10 2013 205 232

(51) Int. Cl.

| | |
|---|---|
| ***B41J 2/01*** | (2006.01) |
| ***B41J 3/407*** | (2006.01) |
| ***B41F 17/18*** | (2006.01) |
| ***B41F 17/00*** | (2006.01) |
| *B41J 11/00* | (2006.01) |

(52) U.S. Cl.

CPC ..... *B41J 3/4073* (2013.01); *B41F 17/002* (2013.01); *B41F 17/18* (2013.01); *B41J 11/002* (2013.01)

(58) Field of Classification Search

None

See application file for complete search history.

(56) References Cited

U.S. PATENT DOCUMENTS

2011/0232514 A1 * 9/2011 Putzer et al. ..... 101/36

FOREIGN PATENT DOCUMENTS

| | | | |
|---|---|---|---|
| CN | 101454212 | A | 6/2009 |
| CN | 101674940 | A | 3/2010 |
| CN | 102271925 | A | 12/2011 |
| DE | 102009013477 | A1 | 9/2010 |
| DE | 102009041527 | A1 | 2/2011 |
| DE | 102010051539 | A1 | 5/2012 |
| DE | 102011119171 | B3 | 2/2013 |
| WO | WO-2004009360 | A1 | 1/2004 |
| WO | WO-2009018893 | A1 | 2/2009 |
| WO | WO 2011018191 | A1 * | 2/2011 |

OTHER PUBLICATIONS

Search report for DE 10 2013 205 232.4, dated Dec. 9, 2013.

Search Report for CN Application No. 2014101080323 dated Jun. 2, 2015.

* cited by examiner

*Primary Examiner* — Bradley Thies

(74) *Attorney, Agent, or Firm* — Marshall, Gerstein & Borun LLP

(57) ABSTRACT

A printing device for printing on containers in a rotationally-driven container conveying unit by means of which containers are conveyed between at least one container feed location and at least one container removal location, the printing device, and including at least one print head and at least one housing for housing a container. Each housing includes a hollow body, which is partially open at least in a printing area and which is used for accommodating the container, the opening for the printing area defining a front side and a side located opposite the front side defining a rear side.

12 Claims, 4 Drawing Sheets

PRINTING DEVICE FOR PRINTING ON CONTAINERS

CROSS-REFERENCE TO RELATED APPLICATION

The present application claims the benefit of priority of German Application No. 10 2013205232.4, filed Mar. 25, 2013. The priority application is incorporated herein by reference in its entirety.

FIELD OF THE DISCLOSURE

The present disclosure relates to a printing device for printing on containers in a rotationally-driven container conveying unit by means of which containers are conveyed between at least one container feed location and at least one container removal location, the printing device having at least one print head and at least one housing for housing a container.

BACKGROUND

Printing devices for printing on containers, e.g. bottles, are known in the prior art e.g. from WO 2009/018893. This publication describes a device for printing on containers by applying a print color or printing ink with print heads for a plurality of colors directly onto the outer surface of the container. This direct printing method competes against labelling and has various advantages in comparison with the labelling method, e.g. simplification of the filling plant or marketing reasons through the optical recognition of directly printed containers. In direct printing processes, containers are serially fed into a container treatment device, in which the containers are then directly printed. The treatment device consists of a rotor which is rotationally driven about a vertical machine axis, a printing unit and a device for drying the printing ink and/or causing it to set. The rotor comprises printing stations formed at regular angular intervals about the machine axis, the printing stations comprising a container support in the form of a rotary table that is rotatable about an axis parallel to the machine axis. Each printing unit may comprise e.g. four print heads for a CMYK color scheme for producing different color sets of a multicolor print as well as a further print head for areal printing or applying a transparent sealing or protective coating. In the WO 2009/018893 publication the print head is arranged on the rotor in opposed relationship with a rotary table and radially further inwards than the rotary table. The print head is additionally arranged such that it is displaceable relative to the rotary table in various axial directions, e.g. such that it moves along with the rotary table in accordance with the rotor movement, so that a container having a circular cross-section can be positioned in front of the print head such that each vertical nozzle row of e.g. an inkjet printer can be positioned at an arbitrary position of the curved container surface, e.g. the bottle surface, at a minimum distance therefrom so as to minimize the amount of color sprayed into the surroundings of the print head.

In particular when 3D bodies having curved or convex surfaces, e.g. bottles or the like, are printed on by means of drop-on-demand inkjet techniques, i.e. contactless, selective spraying-on of individual color droplets by means of a plurality of individual nozzles, it is particularly important that, during the printing process, external forces are, as far as possible, prevented from acting on the droplets exiting the printing nozzle. In addition to weight, electric fields, etc., the air current caused by the movement of the material to be printed on is an important factor. Uncontrolled air currents and turbulences etc. should be as small as possible and reduced to the smallest possible amount during the printing process. Furthermore, some droplets (undesired satellite droplets) are not placed on the substrate during the printing process, such satellite droplets polluting the area where the printing process takes place as a fine ink mist and impairing the print quality.

Due to the open structural design of the printing device according to WO 2009/018893 it is, however, impossible to prevent the inkjet from being deflected by non-foreseeable air currents, whereby the print will be rendered imprecise and parts of the system may also be contaminated with printing ink. Especially in the case of high bottle throughput rates, the resultant high conveying speeds will cause turbulences intensifying a formation of ink mists and leading to a deposit and accumulation of ink particles on machine components and the malfunctions resulting therefrom.

In order to avoid this, DE 10 2009 013477 A1 suggests, for the purpose of reducing contamination problems and improving the print quality, a printing device with a housing provided for printing bottles or similar containers in a rotationally driveable conveyor element with several printing positions. By means of the rotationally driveable conveyor element, the printing positions and/or the containers are moved on a self-contained path of movement between at least one container feed location and at least one container removal location. The print heads moving along with the printing positions and/or the containers are adapted to be moved relative to the outer surface of the respective container for applying a preferably multicolored print image to an outer surface area of the container to be printed on. In addition, a closed housing is suggested, said housing accommodating each container provided at a printing position during the printing process. A print head and a color-fixing device are stationarily integrated in the housing, i.e. such that they cannot be moved relative thereto. In addition, DE 10 2009 013477 A1 suggests means for extracting atomized and/or splashed consumables, such as printing ink.

A drawback of this device is, on the one hand, the complicated mechanism and control of the opening and closing elements of the housing on the rotating part. On the other hand, it is not possible to execute processes, which take place outside of the housing, on the object, e.g. a bottle, enclosed in the housing. In addition, this prior art only allows substantially cylindrical containers to be printed on, since the print head is located in the housing element.

One aspect of the present disclosure is the provision of a printing device for a container to be printed on in a rotationally-driven container conveying unit of a filling plant, the printing device preventing ink mists from depositing on components of the plant and from deteriorating the print quality. Another aspect of the present disclosure to provide a printing device for a filling plant, which is adapted to be used for arbitrary containers irrespectively of the size and the geometry of the containers and which is suitable for carrying out various processes, such as printing processes, marking processes, drying processes, pre-treatment and/or finishing treatment processes, conditioning processes etc.

A printing device of the type specified above includes a housing comprising a hollow body, which is partially open at least in a printing area and which is used for accommodating a container, the opening for the printing area defining a front side and a side located opposite the front side defining a rear side.

The partially open hollow body protects the printing area against draft, so that no ink mist can spread and thus damage components of the plant and deteriorate the print quality. In addition, the opening allows a flexible handling of processing tools, such as inkjet print heads, since the processing tools need not be integrated in the housing.

In particular, the housing may be configured such that various processing tools can releasably be attached to the opening of the partially open hollow body, the following processing tools being adapted to be used individually or in combination: single-color or multi-color inkjet print heads; an UV lamp; a surface conditioning device; a surface sealing device; and an extraction unit.

This will improve the flexibility of use of container printing tools. For example, processing tools used for printing can selectively be arranged stationarily with respect to the rotationally-driven container conveying unit or such that they are independent of the movement of the container conveying unit. Thus, arbitrary processing tools can be associated, at specific moments in time, with a specific printing position on the container to be printed on.

The component "partially open hollow body" of the partially open housing can be realized through various embodiments.

For example, the partially open hollow body normally comprises a cover and a side wall with at least one opening. According to one embodiment, the partially open side wall may be a circular cylinder cut-off in an axial direction, i.e. the partially open hollow body comprises a cover and a side wall with the opening, the side wall having a circular segment-shaped cross-section.

Normally, the printing devices used here are preferably devices with print heads making use of a demand-dependent inkjet, so-called "drop-on-demand" print heads. These devices/methods based on "drop/on/demand" may e.g. be inkjet print heads, piezo print heads, electrostatic print heads and/or printing valve printers.

According to another embodiment, the side wall may comprise two opposed flat lateral elements which are preferably configured as elements tapering conically, e.g. along a radial direction of the rotationally-driven container conveying unit. In the case of this embodiment, the available space is utilized in a particularly efficient manner.

According to a further development of the above, the partially open hollow body additionally comprises a rear-side element interconnecting the two flat elements at the rear of the open hollow body, thus producing a sealing effect against draft or ink mists.

According to one embodiment, the housing additionally comprises a mechanism for providing access to the space provided for the housing at a container feed location and at a container removal location of the rotationally-driven container conveying unit. This embodiment is advantageous in cases where the spatial conditions necessitate complicated robot arm movements for feeding and removing containers, so that complicated feed and removal mechanisms would be required. Feeding and removing processes can be simplified by a mechanism for providing access to the space provided for the housing.

The component "mechanism for providing access" to the partially open housing can be realized through various embodiments.

The mechanism for providing access to the space provided for the housing at a container feed location and at a container removal location of the rotationally-driven container conveying unit may also be realized through the embodiments following herein below.

According to one embodiment, the accessing mechanism is configured such that it moves the open hollow body away from the container reception position in a radial direction relative to an axis of rotation of the rotationally-driven container conveying unit, either in the direction of the axis of rotation of the rotationally-driven container conveying unit or outwards away from the axis of rotation of the container conveying unit.

According to another embodiment, the mechanism may be configured such that it moves the open hollow body upwards so as to open the space for accommodating the container.

According to a further embodiment, the accessing mechanism may be configured such that it folds the open hollow body rearwards about a horizontal axis, e.g. by means of a joint-like device.

According to an embodiment in which the side wall comprises two opposed flat lateral elements and a rear-side element, the partially open hollow body may be bipartite and the accessing mechanism may be provided with a joint on the rear side of the hollow body, so that the hollow body halves can be pivoted rearwards about a vertical axis. Alternatively, the side wall may have a circular segment-shaped cross-section. According to another variant, the mechanism is capable of moving the two hollow body halves apart in a horizontal direction tangentially to the direction of movement of the rotationally-driven container conveying unit.

According to another alternative embodiment, the partially open hollow body comprises a cover, two opposed flat lateral elements and a rear-side element interconnecting the flat elements on the rear side, the accessing mechanism being configured such that it is capable of displacing the flat lateral elements together, or preferably separately, to the rear. The preferred separate displacement offers, on the one hand, sufficient space for container feeding and removal and, on the other hand, a protective effect of the housing is preserved during such feeding and removal.

According to another embodiment, in which the partially open hollow body comprises a cover and a side wall having a circular segment-shaped cross-section, the side wall is bipartite along a vertical axis and the accessing mechanism is configured such that the side wall halves can be displaced rearwards about a common vertical axis of rotation for moving them one on top of the other.

According to a further embodiment, in which the open hollow body comprises flat lateral elements and a rear-side element, the flat lateral elements may be connected by a joint to the rear side, the accessing mechanism being configured such that the flat lateral elements can fold rearwards about a vertical axis through this joint. This embodiment allows two neighbouring housings to share a common partition and an accessing mechanism, which means that space and material are utilized in a particularly efficient manner.

Alternatively to the above-mentioned joint, the flat lateral elements may be configured such that they are resilient or flexible, so that they can be bent rearwards about a vertical axis. This simplifies the structural design, since neither and articulation mechanism nor an actuator are necessary for moving the lateral parts. Due to the flexibility of the flat lateral elements, the elements can be moved e.g. by the robot arms or gripping arms of the feeding and removing devices or by the object to be printed on itself.

According to a further embodiment, the printing device additionally comprises a plurality of tables having placed thereon at least one of the at least one housing, at least one container feeding device and at least one container removing device. The tables may be configured as rotary tables, so that e.g. a container which is to be printed on and which has a curved surface can be positioned more easily in front of respective nozzle rows of inkjet print heads. Preferably, a housing is provided for each table, which opens through the accessing mechanism the space provided for the housing at the container feeding device and the container removing device.

According to one embodiment, an extraction unit is provided in the side wall or on the table so as to extract ink mists that may perhaps occur and so as to provide, if necessary, constant flow conditions in the printing area.

Depending on the circumstances prevailing in the plant in question, the partially open hollow body can be arranged such that the opening of the housing and thus the front side of the housing is directed radially outwards or inwards with respect to the rotationally-driven container conveying unit. If the front side is directed radially outwards, the processing tools on the outer side of the rotationally-driven container conveying unit must be either fixedly associated with a container position or arranged such that they can flexibly be associated with a plurality of container positions. If the opening and thus the front side is directed radially inwards, the processing tools must be arranged in a corresponding manner on the inner side of the rotationally-driven container conveying unit. For feeding and removing containers, an additional opening, which an be closed, if necessary, may be provided on the rear side of the housing (on the side directed radially outwards according to the above definition of front and rear sides).

Making use of a rotary table, it is also possible to provide two openings in the housing, the respective openings being directed radially inwards and outwards with respect to the rotationally-driven container conveying unit. The printing position on the container may then be placed at the respective opening, e.g. by means of the rotary table.

According to one embodiment, the hollow body of the housing including an opening on at least one side thereof is connected to a container centering head above the table of the rotationally-driven container conveying unit, so that the container centering head can be used as a mechanism for lifting the housing thus providing access to the space provided for the housing at a container feed location and a container removal location.

Furthermore, a sealing means is provided between the side wall of the housing and the table according to one embodiment, said sealing means comprising e.g. brushes, a hydraulic seal, a bellows, a labyrinth seal or a combination thereof. Said sealing means efficiently improves a possibly executed extraction on the one hand and avoids uncontrolled air currents in the printing area on the other.

The present disclosure also relates to the housing as an independent unit, e.g. as a spare part in a filling plant.

BRIEF DESCRIPTION OF THE DRAWINGS

In the following, embodiments, further developments, advantages and possibilities of use of the present disclosure will be explained in more detail on the basis of the figures enclosed. All the features described and/or illustrated, individually or in any combination, are generally subject of the disclosure, regardless of their combination in the claims or the references to preceding claims. In addition, the content of the claims is made a part of the description. In the figures.

DETAILED DESCRIPTION OF THE PREFERRED EMBODIMENT

The present disclosure was created for simplifying the complicated and expensive mechanism and control of the opening and closing elements of the housing in printing devices used in filling plants for directly printing on 3D bodies by means of drop-on-demand techniques; such drop-on-demand techniques may be based on devices/methods, such as inkjet print heads, piezo print heads, electrostatic print heads and/or printing valve printers. One aspect of the present disclosure is the omission of parts of the printing device, which are not required, so as to avoid e.g. undesirable air currents in the printing area or ink and print-color mists. A further aspect of the present disclosure was to configure the printing device flexibly enough to allow at the printing positions also an execution of processes which are not directly related to printing, but which may also be related to the cleaning and sealing of the surface to be printed on or of the printed surface.

Figure 1:
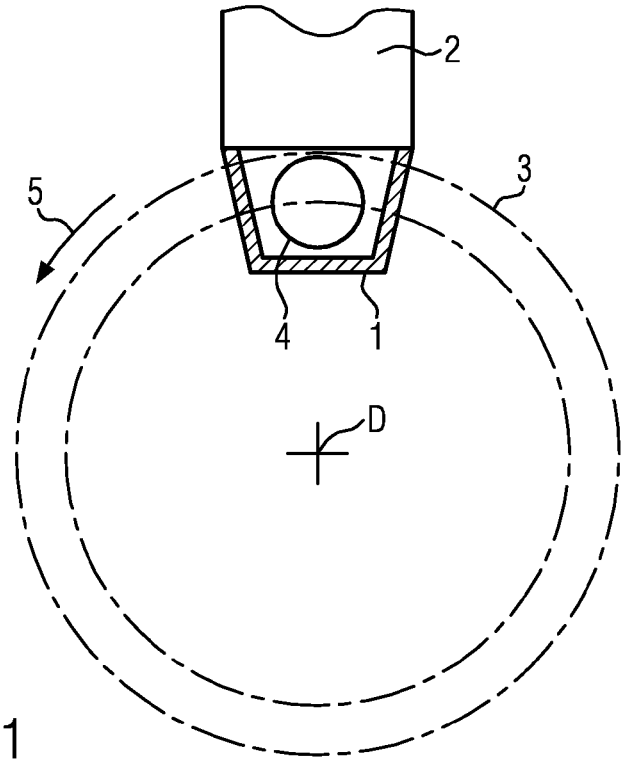
FIG. 1 shows a sectional top view through a single housing for a printing device in a rotationally-driven container conveying unit of a filling plant according to the present disclosure.

FIG. 1 shows schematically the concept of the present disclosure. A container 4 (e.g. a bottle) is located on a rotationally-driven container conveying unit 3. The rotationally-driven container conveying unit 3 is only shown as a broken contour line in FIG. 1. Reference numeral 5 symbolizes the direction in which the rotationally-driven container conveying unit 3 rotates about an axis of rotation D of the machine. The direction of rotation shown in FIG. 1 is an anticlockwise direction. The direction of rotation is, however, not important and may also be a clockwise direction, as shown e.g. in FIG. 2. The container 4 is enclosed by a housing 1 such that an area to be printed on remains open. The opening allows the container to be accessed by a processing tool 2, e.g. single-color or multi-color inkjet print heads, an UV lamp, a surface conditioning device, a surface sealing device and/or an extraction unit. The processing tool may, for example, be a printing unit comprising e.g. four print heads for a CMYK color scheme. The printing unit may also comprise further print heads for additional colors, e.g. white and/or special colors, for a priming coat as first printing step or for a base layer, e.g. an adhesive agent. The processing tools 2 do not define an integral unit with the housing 1, but may be positioned in the surroundings of the opening according to requirements, so that uncontrolled air currents and ink mists will be avoided during printing. In the representation according to FIG. 1, the opening of the housing 1 is directed radially outwards. Depending on the local circumstances and the construction of the filling plant, the opening of the housing 1 may, however, also be directed radially inwards. In the description following herein below, the housing side including the opening will be referred to as front side and the side located opposite the front side will be referred to as rear side.

Figure 2:
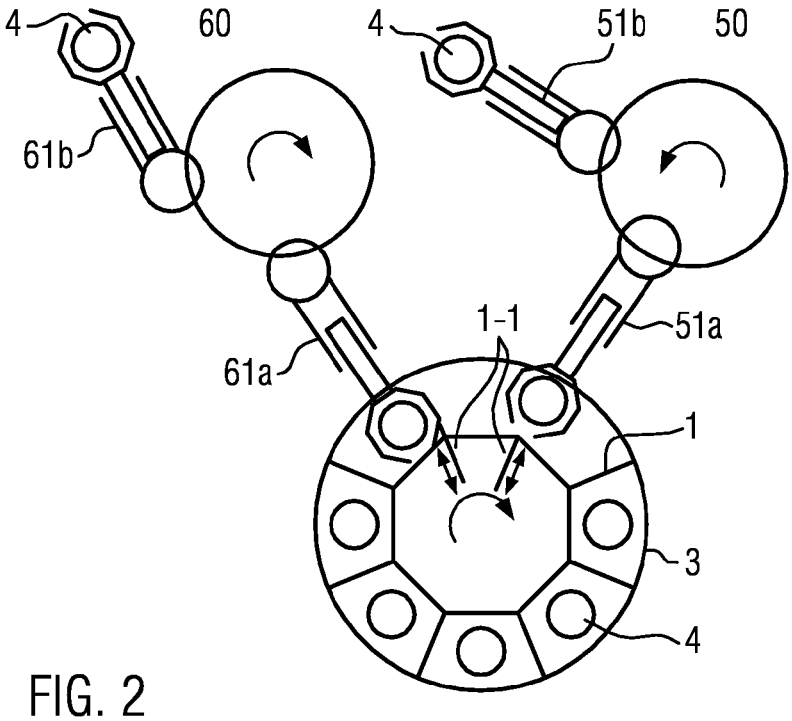
FIG. 2 shows a schematic top view of a printing device according to the present disclosure with devices for feeding and removing containers.

FIG. 2 shows a scheme with the functional principle of the printing device in the rotationally-driven container conveying unit 3 in combination with container feeding devices 50 and container removing devices 60. Reference numerals in FIG. 2 and in all the following figures that are identical to the reference numerals in FIG. 1 identify identical features and, if no further explanations should be given in the following figures, the description according to FIG. 1 shall apply. FIG. 2 shows a typical situation during a continuous operation of the printing device where the rotationally-driven container conveying unit 3 rotates clockwise continuously. At the removal side, containers 4 are continuously removed from the rotationally-driven container conveying unit 3 by means of the container removing device 60. In FIG. 2 the container removing device 60 is shown as a device having a plurality of arms 61*a*, 61*b*, which grip a container 4 on the rotationally-driven container conveying unit 3 and place it e.g. onto a discharging conveyor belt (not shown). The container feeding device 50 has a structural design similar to that of the container removing device and comprises a plurality of arms 51*a*, 51*b*, which transfer a container 4 e.g. from a supplying conveyor belt (not shown) to a position on the rotationally-driven container conveying unit 3. As can be seen in FIG. 2, space for the arms 61*a* and 51*a* must be created in view of the high speed of the rotationally-driven container conveying unit 3 during feeding and removing of the containers, so as to avoid collisions of machine parts and the resultant damage. In FIG. 2 this is symbolized by side walls 1-1 of the housings 1, which are radially movable relative to an axis of rotation D of the machine (as shown in FIG. 1).

Figure 3:
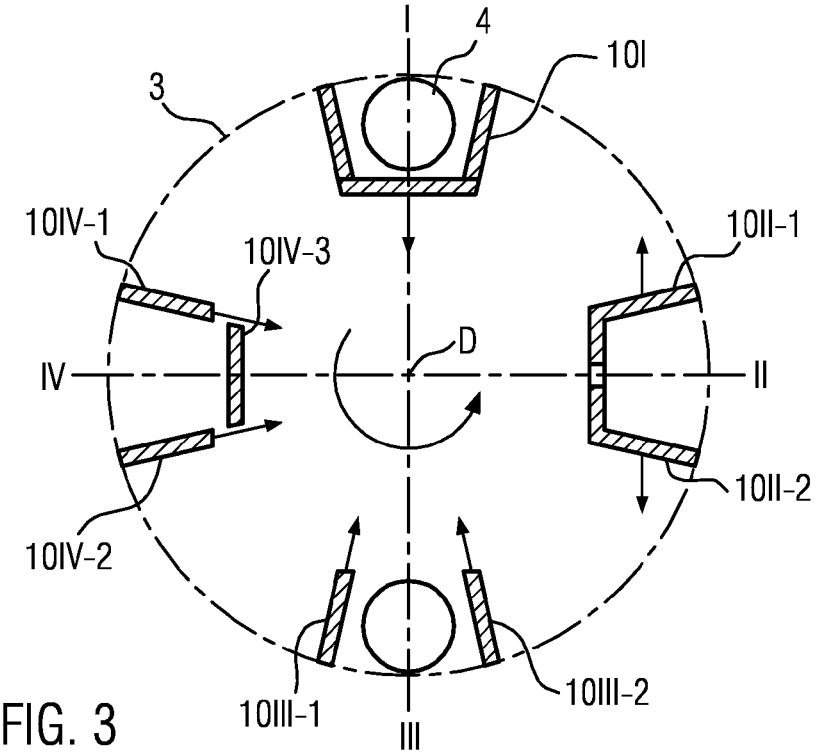
FIG. 3 shows four variants of a mechanism for providing access to the space provided for the housing in a printing device according to the present disclosure.

FIG. 3 shows different variants of a mechanism for providing access to the space provided for the housing on a container feeding device 50 and a container removing device 60 of the rotationally-driven container conveying unit 3. A feature which all these four variants have in common is that the housing has flat, i.e. non-curved side walls.

According to variant I, the side walls of the housing 10I consist of a substantially U-shaped part having a flat rear wall and conically tapering adjoining side walls and an opening which is directed radially outwards. In the case of variant I, the whole housing 101 is displaced radially backwards in the direction of the axis of rotation D so as to create space for feeding and removing containers.

Variant 11 differs from variant 1 in so far as the U-shaped part is bipartite along a vertical plane extending radially with respect to an axis of rotation D of the machine, so that two housing parts 10II-1 and 1011-2 are defined. In order to create space for feeding and removing the containers, the two housing parts 1011-1 and 1011-2 are displaced in opposite directions tangentially to the rotational movement.

Variant IV differs from variant I insofar as the rear wall 101V-3 is not fixedly connected to the adjoining side walls 101V-1 and 101V-2. In order to create space for feeding and removing the containers, the adjoining side walls 101V-1 and 101V-2 can be displaced, in common or separately, past the rear wall in the direction of the center of rotation D. This variant allows to provide a housing for containers in a particularly material-saving manner, since only one movable partition is required for two adjoining container positions. In addition, it is not necessary to move the whole housing when feeding or removing containers, but it will suffice to displace a single adjoining side wall 101V-1 or 101V-2.

Variant II1 according to FIG. 3 differs from variant IV insofar as no rear wall is used. This variant is particularly advantageous in the event that processing tools are also used on the back of the housing. Also in this case, the side walls 10111-1 and 10111-2 are displaced in the direction of the center of rotation D when feeding and removing containers, so as to create space for the feeding and removing robots. In FIG. 3 the side walls 101, 1011-1, 1011-2, 10111-1, 10111-2 and 10IV-1 as well as 10IV-2 adjoining the back are shown as surfaces tapering conically in the direction of the center of rotation D. This is advantageous for saving material and space, since it corresponds to the circular geometry of the rotationally-driven container conveying unit 3. The adjoining side walls may, however, also be arranged parallel to one another, in particular in the case of large radii of the rotationally-driven container conveying unit 3.

Figure 4:
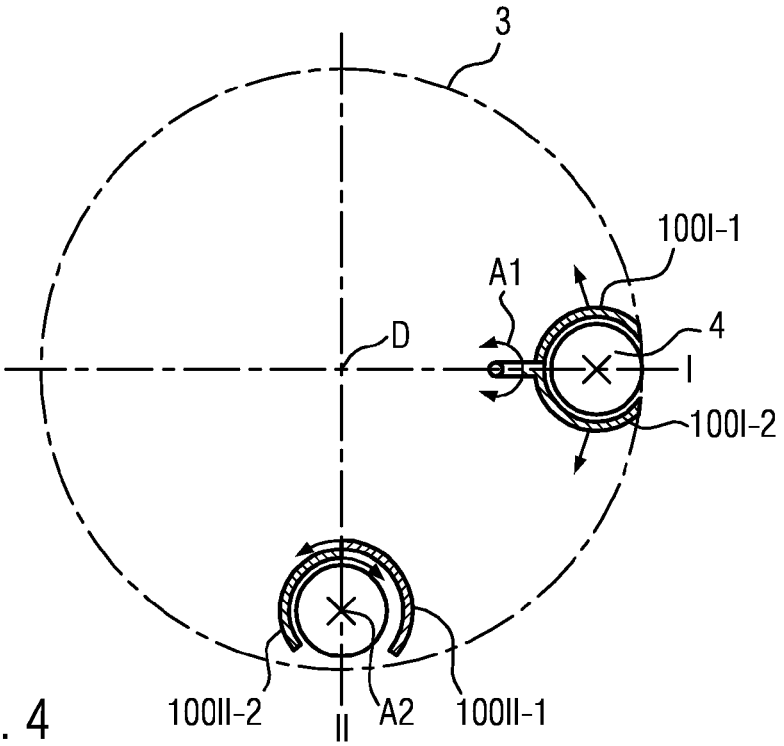
FIG. 4 shows two variants of a mechanism for providing access to the space provided for the housing, for a housing having a circular segment-shaped cross-section in a printing device according to the present disclosure.

FIG. 4 shows further variants of housings and mechanisms for providing access to housings with a circular segment-shaped cross-section, i.e. the side walls of the housings have the shape of a circular cylinder with one segment of the circular cylinder missing.

In variant I the housing is divided along a vertical plane extending radially with respect to an axis of rotation D of the machine, so that two housing halves 1001-1 and 1001-2 are defined. The two halves 1001-1 and 1001-2 are connected at the back with a joint, so that the two housing halves 1001-1 and 1001-2 can fold rearwards about a vertical axis Al so as to create space for feeding and removing containers.

According to variant 11 the housing is again divided along a vertical plane extending radially with respect to an axis of rotation D of the machine and defines two housing halves 10011-1 and 10011-2. Both housing halves 10011-1 and 10011-2 are rotatable about a common axis A2 that defines approximately also a vertical axis of rotation of a container 4 positioned in the housing. By rotating the housing halves 10011-1 and 10011-2 about the common axis of rotation A2, the two housing halves can be displaced rearwards for moving them one on top of the other, so that space is created for feeding and removing the containers.

Figure 5:
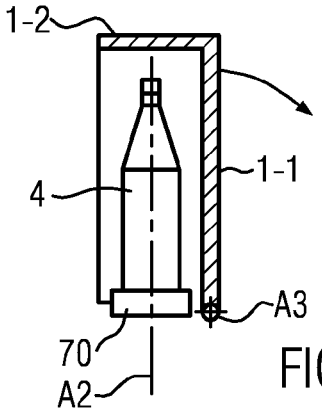
FIG. 5 shows a folding mechanism for providing access to the space provided for the housing in a printing device according to the present disclosure.

FIG. 5 illustrates a further mechanism according to the present disclosure used for providing access to the space provided for the housing. FIG. 5 shows a lateral cross-section of the housing 1, the container 4 and of a rotary table 70 onto which the container 4 is placed. The rotary table 70 is a component part of the rotationally-driven container conveying unit 3 and is supported such that it is rotatable about an axis A2, so that the container 4 can be rotated relative to the housing 1. Preferably, all the container positions in the rotationally-driven container conveying unit 3 are provided with a rotary table. The housing 1 comprises a cover 1-2 and a circumferentially extending side wall 1-1 that remains open on one side, i.e. on the left side in the representation shown in FIG. 5. The housing additionally has a hinge-like structure on the back of the housing 1, so that the housing 1 can be folded rearwards about a horizontal axis A3 oriented tangentially to the axis of rotation of the rotationally-driven container conveying unit 3, so as to create space for feeding and removing containers.

Figure 6:
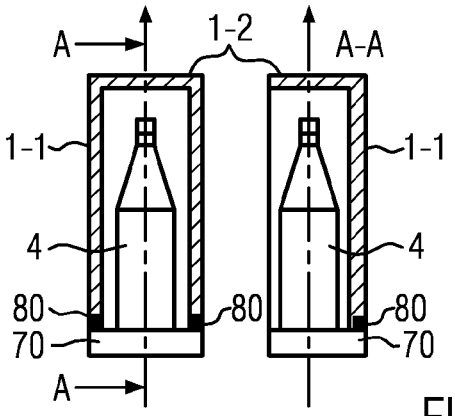
FIG. 6 shows two side views from different directions of a mechanism for lifting the housing in a printing device according to the present disclosure.
Figure 7:
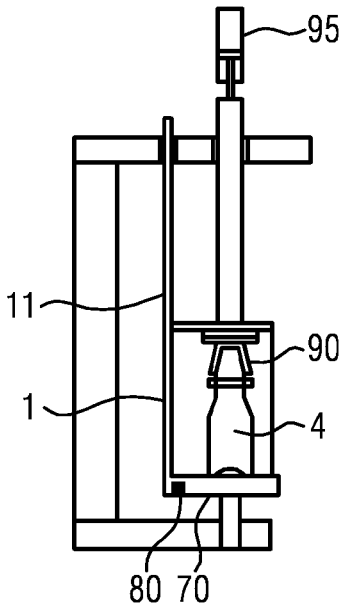
FIG. 7 shows a sectional side view of a mechanism for lifting the housing for a printing device according to the present disclosure.

FIGS. 6 and 7 show a housing 1 and an accessing mechanism which lifts the housing 1 upwards so as to create space for feeding and removing containers. In particular, FIG. 6 shows two lateral sectional drawings in which the housing 1 can be moved upwards. The right side of FIG. 6 shows a section along line A-A of the illustration on the left side of FIG. 6. The figures show the container 4, e.g. a bottle, which rests on a rotary table 70. The housing 1 comprises a cover 1-2 and side walls 1-1. The side wall 1-1 is open towards one side, as can be seen in the sectional drawing on the right-hand side of FIG. 6. The upwardly directed arrow on the cover 1-2 of the housing 1 indicates the direction in which the housing 1 is moved, when the container 4 is fed or removed. The housing 1 is in tight contact with the rotary table 70, so that it is not necessary to provide a separate bottom part of the housing. Brushes, by way of example, may be used as sealing means 80 for producing a sealing effect with respect to the bottom. Hydraulic seals, labyrinth seals or bellows may, however, be used as well. If bellows are used, care should be taken that the angle of rotation of the rotary table never exceeds 360°, so that the torsional load acting on the bellows will not become excessively high. In order to allow, if necessary, larger dimensions of the housing, e.g. for larger containers, the rotary table may also be configured with larger dimensions so that the housing will always be in tight contact with the rotary table. In particular, the diameter of the rotary table may be more than twice as large as the largest bottle or container to be assumed.

Alternatively, the rotary table may be arranged separately from the housing, i.e. the "housing bottom" consists of additional components. A "rotary table projecting beyond" the container contour can be avoided in this way, and, consequently, a print head/printing unit can also be arranged in the bottom area of the container at a minimum distance from the container, so that printing or an execution of processes will be possible also in this area.

FIG. 7 shows a realization of a mechanism for lifting the housing 1. In rotationally-driven container conveying units, such as container carousels or transport star wheels, centering heads are provided, by means of which the containers are placed in position on the rotary table. FIG. 7 shows a centering head 90, which centers a bottle 4 on the rotary table 70. FIG. 7 additionally shows a drive unit 95 for the centering head, said drive unit 95 being e.g. be a linear motor or a pneumatic cylinder. The centering head 90 is fixed to the cover of the housing 1. The drive for the centering head, e.g. the pneumatic cylinder, moves the centering head 90 upwards, away from the bottle 4. This has the effect that also the housing 1 is lifted so as to create space for feeding and removing containers. The housing 1 is sealed off from the rotary table 70 by a sealing 80. The housing additionally has a torque support 11 preventing the housing 1 from rotating together with the rotary table 70.

Figure 8:
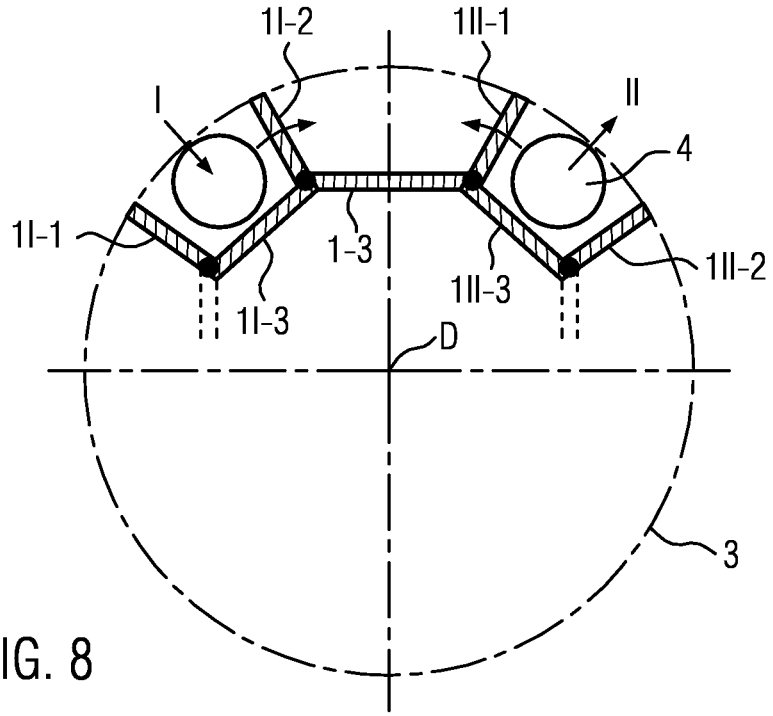
FIG. 8 shows a schematic fragmentary view of a printing device according to the present disclosure.

FIG. 8 shows a particularly efficient embodiment of the present disclosure. FIG. 8 shows in particular an embodiment in which the rear sides of container positions define an equilateral N-polygon, N corresponding to the number of container conveying positions on the rotationally-driven container conveying unit. Each edge of the N-polygon is adjoined by a side wall, which extends radially outwards with respect to the rotationally-driven container conveying unit. In FIG. 8 only the section between the container feed location II and the container removal location I is shown in detail. In this case the rotationally-driven container conveying unit 3 rotates clockwise. Neighboring container accommodation positions are separated by a respective common partition 11-1, 11-2, 111-1, 111-2. These partitions are connected to the corners of the N-polygon, so that two respective neighboring partitions and a side face of the polygon define a housing for a container 4. FIG. 8 shows three rear walls 11-3, 1-3, 111-3, i.e. three faces of the N-polygon. The container feeding and container removing devices are arranged relative to the rotationally-driven container conveying unit 3 such that the container position between container feed II and container removal I remains empty. In this case, the side wall 11-2 can fold to the empty position and create space for the container removing device during the removal process. Likewise, the side wall 111-1 can fold in the direction of the rear wall 1-3 of the empty container position, so as to create space for the container feeding device. The partitions 11-1, 11-2, 111-1, 111-2 are movably attached to the edges of the N-polygon. For example, the partitions may be pivoted via an articulation structure or hinges about a vertical axis on the edge of the N-polygon, as shown in FIG. 8 by the arrows on the side walls 11-2 and 111-1. Alternatively, the side walls can be fixedly connected to the rear walls on the edges of the N-polygon. In this case, the side walls are produced from a flexible material or they are spring mounted, so that they can be pushed out of the way by a gripper of a container feeding or a container removing device. In this case, no actuator will be necessary for moving the side walls, since the resilient restoring forces of the side walls will re-establish the original shape of the housing.

The surface texture and the geometry of the housing may also be configured such that an optimum light yield will be accomplished, when an UV lamp is used as a processing tool for curing the layer that has been printed on and for the purpose of sealing. In particular, the inner side of the housing may be partially mirrored and shaped such that the highest possible amount of UV light coming from the UV lamp is directed onto the printed area. In addition, the housing may be configured such that light reflections are prevented, e.g. by special absorber areas or light traps.

Especially, the housing may be configured such that it encloses more than 50%, in particular more than 60% of the surface of a container to be printed on during the printing process.

In particular, the lateral parts of the housing do not have incorporated therein any functions for manipulating the container.

According to one embodiment, no elements of the housing are arranged such that they are movable relative to the rotor, but the elements are fixedly secured to the rotor. In particular, this embodiment comprises at least one drive in addition to the rotary drive, so as to move the container relative to the rotor and the housing, especially in a pivotal or a linear movement. This drive can, in principle, also be used in the case of the other embodiments and is especially used for introducing the container into the housing. It may, however, also serve to move the partially printed container to a position at which UV lamps are provided for the purpose of drying.

In particular, the device comprises a plurality of treatment positions of the same type arranged on a rotor in an equidistant manner, each treatment position being capable of accommodating one container. It would, however, also be imaginable to accommodate at least two or a group of containers per treatment position.

The rotor is especially driven in cycles, and in particular such that a container comes to a stop in front of at least one stationary print head and is then rotatingly driven, e.g. through the rotary table drive, in front of said print head during the printing process. For improved performance, the rotor may also rotate continuously. In this case, the print heads may be arranged on the rotor such that they rotate together therewith, but it would also be imaginable to arrange the print heads in a stationary manner and to move the objects to be printed on continuously past the print heads, in particular if the printing speed of the print heads is very high or if at least one side of the object to be printed on is convex in shape and has a radius that is larger than the radii occurring in the case of the largest round objects that can be accommodated.

Instead of placing the object to be printed on onto a rotary table, the object may also be accommodated only in the area of its upper end (in the case of bottles at the bottle neck or in the area of the opening). The drive for rotating the object may then cooperate with this accommodation area.

What is claimed is:

1. A printing device for printing on containers in a rotationally-driven container carousel by means of which containers are conveyed between at least one container feed location and at least one container removal location, the printing device comprising:

at least one housing for housing a container, each housing being mounted to the carousel to receive the containers onto the carousel and into the housing while each housing is mounted to the carousel and each housing including at least one side wall that defines at least a portion of an opening which is used for accommodating the container; and at least one processing tool separate from the housing; wherein the opening defines a front side of the housing and a side of the housing located opposite the front side defines a rear side of the housing;

each housing is configured such that the at least one processing tool is positioned from outside the housing into the opening with each housing mounted to the carousel; and each housing is configured such that the at least one side wall of the housing is moved to allow placement of the container onto the carousel at the container feed location and removal of the container from the carousel at the container removal location.

2. The printing device according to claim 1, wherein the at least one processing tool is selected from one of the group comprising:

a print head;

a print head for a priming coat and/or adhesive agents;

an UV lamp;

a surface conditioning device;

a surface sealing device; and an extraction unit.

3. The printing device according to claim 1, wherein the housing comprises a cover and the cover and the at least one side wall define the opening, the at least one side wall having a circular segment shaped cross-section.

4. The printing device according to claim 3, wherein the housing comprises two side walls divided along a vertical axis and configured such that the side walls can be displaced rearwards about a common vertical axis of rotation for moving one of the two side walls on top of the other.

5. The printing device according to claim 1, wherein the housing comprises a cover and two opposed flat lateral side walls, the cover and the two side walls defining the opening.

6. The printing device according to claim 5, wherein the housing further comprises a rear-side element interconnecting the two flat lateral side walls at the rear side of the housing.

7. The printing device according to claim 6, wherein the flat lateral side walls and the rear side element are configured such that:

each of the flat lateral side walls are connected by a joint to the rear-side element, wherein the housing is configured such that each of the flat lateral side walls can fold rearwards about a respective vertical axis; or the flat lateral side walls are adapted to be resiliently bent rearwards.

8. The printing device according to claim 5, wherein the housing is configured such that at least one of the side walls is displaced rearwards.

9. The printing device according to claim 5, wherein the two opposed flat lateral side walls are configured as conically tapering elements.

10. The printing device according to claim 1, wherein each housing is configured to move in a manner selected from the following group:

moving the housing in a radial direction relative to an axis of rotation of the carousel;

moving the housing upwards away from the carousel;

folding the housing rearwards about a horizontal axis;

pivoting the at least one side wall and a second side wall of the housing rearwards about a vertical axis; and moving the at least one side wall and a second side wall of the housing apart in a horizontal direction tangentially to the direction of movement of the carousel, the housing being bipartite along a vertical plane in a radial direction and having a joint on the rear side of the housing.

11. The printing device according to claim 1, wherein the opening is directed radially outwards or inwards with respect to the carousel.

12. A housing for use in a printing device for printing on containers in a rotationally-driven container carousel, the housing comprising:

the housing mounted to the carousel to receive the containers onto the carousel and into the housing while the housing is mounted to the carousel, the housing including at least one side wall that defines at least a portion of an opening that is used for accommodating the container, the opening defining a front side and a side located opposite the front side defining a rear side; wherein the housing is configured such that the at least one processing tool, separate from the housing, is positioned from outside the housing into the opening with each housing mounted to the carousel; and the housing is configured such that the at least one side wall of the housing is moved to allow placement of the container onto the carousel at a container feed location and removal of the container from the carousel at a container removal location.

* * * * *